US006998032B2

(12) United States Patent
De Nora et al.

(10) Patent No.: US 6,998,032 B2
(45) **Date of Patent: *Feb. 14, 2006**

(54) METAL-BASED ANODES FOR ALUMINIUM ELECTROWINNING CELLS

(75) Inventors: Vittorio De Nora, Nassau (BS); Jean-Jacques Duruz, Geneva (CH)

(73) Assignee: Moltech Invent S.A., Luxembourg ( * ) Notice: Subject to any disclaimer, the term of this patent is extended or adjusted under 35 U.S.C. 154(b) by 563 days.

This patent is subject to a terminal disclaimer.

(21) Appl. No.: 10/161,318

(22) Filed: Jun. 3, 2002

(65) Prior Publication Data

US 2003/0221970 A1 Dec. 4, 2003

(51) Int. Cl.
*C25B 11/04* (2006.01)

(52) U.S. Cl. ..... 204/293; 204/291; 204/243.1; 205/384; 205/385; 205/387; 205/394

(58) Field of Classification Search ..... 204/293, 204/291, 243.1; 205/384, 385, 387, 394; 423/594.1, 594.3

See application file for complete search history.

(56) References Cited

U.S. PATENT DOCUMENTS

2003/0226760 A1 * 12/2003 Duruz et al. ..... 205/373

* cited by examiner

*Primary Examiner*—Bruce F. Bell
(74) *Attorney, Agent, or Firm*—Jayadeep R. Deshmukh

(57) ABSTRACT

An anode of a cell for the electrowinning of aluminium comprises a nickel-iron alloy substrate having a nickel metal rich outer portion with an electrolyte pervious integral nickel-iron oxide containing surface layer which adheres to the nickel metal rich outer portion of the nickel-iron alloy and which in use is electrochemically active for the evolution of oxygen. The oxide surface layer has a thickness such that, during use, the voltage drop therethrough is below the potential of dissolution of nickel-iron oxide. The nickel metal rich outer portion may contain cavities some or all of which, after oxidation, are partly or completely filled with iron oxides to form iron oxide containing inclusions.

45 Claims, No Drawings

METAL-BASED ANODES FOR ALUMINIUM ELECTROWINNING CELLS

FIELD OF THE INVENTION

This invention relates to non-carbon, metal-based, anodes for use in cells for the electrowinning of aluminium from alumina dissolved in a fluoride-containing molten electrolyte, methods for their fabrication, and electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Heroult, has not evolved as many other electrochemical processes.

The anodes are still made of carbonaceous material and must be replaced every few weeks. During electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

Using metal anodes in aluminium electrowinning cells would drastically improve the aluminium process by reducing pollution and the cost of aluminium production.

U.S. Pat. No. 4,374,050 (Ray) discloses inert anodes made of specific multiple metal compounds which are produced by mixing powders of the metals or their compounds in given ratios followed by pressing and sintering, or alternatively by plasma spraying the powders onto an anode substrate. The possibility of obtaining the specific metal compounds from an alloy containing the metals is mentioned.

U.S. Pat. No. 4,614,569 (Duruz/Derivaz/Debely/Adorian) describes non-carbon anodes for aluminium electrowinning coated with a protective coating of cerium oxyfluoride, formed in-situ in the cell or pre-applied, this coating being maintained by the addition of a cerium compound to the molten cryolite electrolyte. This made it possible to have a protection of the surface from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer. Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective oxygen barrier layer. However, full protection of the alloy substrate was difficult to achieve.

U.S. Pat. No. 5,510,008 (Sekhar/Liu/Duruz) discloses an anode made from an inhomogeneous porous metallic body obtained by micropyretically reacting a metal powder mixture of nickel, iron, aluminium and optionally copper. The porous metal is anodically polarised in-situ to form a dense iron-rich oxide outer portion whose surface is electrochemically active. Bath materials such as cryolite which may penetrate the porous metallic body during formation of the oxide layer become sealed off from the electrolyte and from the active outer surface of the anode where electrolysis takes place, and remain inert inside the electrochemically-inactive inner metallic part of the anode.

Metal or metal-based anodes are highly desirable in aluminium electrowinning cells instead of carbon-based anodes. Many attempts were made to use metallic anodes for aluminium production, however they were never adopted by the aluminium industry for commercial aluminium production because their lifetime must still be increased.

OBJECTS OF THE INVENTION

A major object of the invention is to provide an anode for aluminium electrowinning which has no carbon so as to eliminate carbon-generated pollution and has a long life.

A further object of the invention is to provide an aluminium electrowinning anode material with a surface having a high electrochemical activity for the oxidation of oxygen ions and the formation of bimolecular gaseous oxygen and a low solubility in the electrolyte.

Another object of the invention is to provide an anode for the electrowinning of aluminium which is covered with an adherent electrochemically active layer.

Yet another object of the invention is to provide an improved anode for the electrowinning of aluminium which is made of readily available material(s).

Yet another object of the invention is to provide operating conditions for an aluminium electrowinning cell under which the contamination of the product aluminium is limited.

SUMMARY OF THE INVENTION

The invention relates to an anode of a cell for the electrowinning of aluminium from alumina dissolved in a fluoride-containing molten electrolyte. The anode comprises a nickel-iron alloy substrate having a nickel metal rich outer portion with an integral nickel-iron oxide containing surface layer which is pervious to electrolyte and adheres to the nickel metal rich outer portion of the nickel-iron alloy substrate. The electrolyte-pervious surface layer in use is electrochemically active for the evolution of oxygen gas.

Cermet anodes which have been described in the past in relation to aluminium production have an oxide content which forms the major phase of the anode. Such anodes have an overall electrical conductivity which is higher than that of solid ceramic anodes but insufficient for industrial commercial production. Moreover, the uniformly distributed metallic phase is exposed to dissolution into the electrolyte.

Conversely, anodes predominantly made of metal and protected with a thick oxide outer layer, e.g. as disclosed in U.S. Pat. No. 5,510,008 (Sekhar/Liu/Duruz), have a higher conductivity and longer life because the metal is normally shielded from the bath and resists dissolution therein. However, in case such a thick oxide layer is damaged, molten electrolyte may penetrate into cracks between the metallic inner part and the oxide layer. The surfaces of the crack would then form a dipole between the metallic inner anode part and the oxide layer, causing electrolytic dissolution of the metallic inner part into the electrolyte contained in the crack and corrosion of the metallic anode part underneath the thick oxide layer.

The anode of the present invention provides a solution to this problem. Instead of being covered with a thick protective oxide layer, during use the nickel-iron alloy substrate contacts or virtually contacts molten electrolyte circulating through the electrolyte-pervious surface layer. As opposed to prior art anodes, the electrolyte close to the nickel-iron alloy substrate, typically at a distance of less than 10 micron, is continuously replenished with dissolved alumina. The electrolysis current does not dissolve the anode. Instead the entire electrolysis current passed at the anode surface is used for the electrolysis of alumina by oxidising oxygen-containing ions directly on the active surfaces or by firstly oxidising fluorine-containing ions that subsequently react with oxygen-containing ions, as described in PCT/IB99/01976 (Duruz/de Nora).

Furthermore, the overall electrical conductivity of the metal anode according to the present invention is substantially higher than that of prior art anodes covered with a thick oxide protective layer or made of bulk oxide.

Usually, the metal phase underlying the electrochemically active surface layer of this anode forms a matrix containing a minor amount of metal compound inclusions, in particular oxide inclusion resulting from a pre-oxidation treatment in an oxidising atmosphere, which matrix confers an overall high electrical conductivity to the anode.

The electrolyte-pervious electrochemically active surface layer of the invention is usually a very thin one, preferably having a thickness of less than 50, possibly less than 100 micron or at most 200 micron.

Such a thin electrolyte-pervious electrochemically active surface layer offers the advantage of limiting the width of possible pores and/or cracks present in the surface layer to a small size, usually below about a tenth of the thickness of the surface layer. When a small pore and/or crack is filled with molten electrolyte, the electrochemical potential difference in the molten electrolyte across the pore and/or crack is below the reduction-oxidation potential of any metal oxide of the surface layer present in the molten electrolyte contained in the pore and/or crack. Therefore, such an electrolyte-pervious surface layer cannot be dissolved by electrolysis of its constituents within the pores and/or cracks. Thus, the pores and/or cracks should be so small that when the surface layer is polarised, the potential differential through each pore or crack is below the potential for electrolytic dissolution of the oxide of the surface layer.

This means that, inside the electrolyte-pervious surface layer, no or substantially no oxide of the surface layer should be able to dissolve electrolytically when the surface layer is polarised. For instance, the thinness of the oxide surface layer is such that, when polarised during use, the voltage drop therethrough is below the potential for electrolytic dissolution of the oxide of the surface layer.

Another advantage which is derived from a thin electrochemically active and electrolyte-pervious surface layer can be observed when electrolyte contained in pores and/or cracks of the surface layer reaches the nickel metal rich outer portion of the nickel-iron alloy. When this happens, the thinness of the surface layer permits oxygen evolved on the surface layer to reach the nickel metal rich outer portion, which leads to the formation of a passive layer of nickel oxide on the nickel metal rich outer portion where contacted by molten electrolyte, avoiding the dissolution of nickel cations from the nickel metal rich outer portion into the molten electrolyte.

Before use, the anode can have a Ni/Fe atomic ratio below 1 or of at least 1, in particular from 1 to 4.

The nickel metal rich outer portion may have a porosity obtainable by oxidation in an oxidising atmosphere before use. This porosity may contain cavities, in particular round or elongated cavities, which are partly or completely filled with iron compounds, in particular oxides resulting from an oxidation treatment in an oxidising atmosphere, and possibly also nickel compounds, such as nickel oxides or iron-nickel oxides, to form inclusions of iron compounds or iron and nickel compounds.

The inclusions may be iron-rich nickel-iron oxides, typically containing oxidised iron and oxidised nickel in an Fe/Ni atomic ratio above 2.

Usually the nickel metal rich outer portion has a decreasing concentration of iron metal towards the electrochemically active surface layer. The nickel metal rich outer portion, where it reaches the surface layer, may comprise nickel metal and iron metal in an Ni/Fe atomic ratio of about 3 or more.

The nickel-iron alloy may further comprise a non-porous inner portion which is oxide-free.

The electrochemically active surface layer usually comprises iron-rich nickel-iron oxide, such as nickel-ferrite, in particular non-stoichiometric nickel-ferrite. For instance, the surface layer may comprise nickel-ferrite having an excess of iron or nickel and/or an oxygen-deficiency.

The nickel-iron alloy usually comprises nickel metal and iron metal in a total amount of at least 65 weight %, usually at least 80, 90 or 95 weight %, of the alloy, and further alloying metals in an amount of up to 35 weight %, in particular up to 5, 10 or 20 weight %, of the alloy. Minor amounts of further elements, such as carbon, boron, sulphur, phosphorus or nitrogen, may be present in the nickel-iron alloy, usually in a total amount which does not exceed 2 weight % of the alloy.

For example, the nickel-iron alloy can comprise at least one further metal selected from chromium, copper, cobalt, silicon, titanium, tantalum, tungsten, vanadium, zirconium, yttrium, molybdenum, manganese and niobium in a total amount of up to 5 or 10 weight % of the alloy. The nickel-iron alloy may also comprise at least one catalyst selected from iridium, palladium, platinum, rhodium, ruthenium, tin or zinc metals, Mischmetals and their oxides and metals of the Lanthanide series and their oxides as well as mixtures and compounds thereof, in a total amount of up to 5 weight % of the alloy. Furthermore, the nickel-iron alloy may comprise aluminium in an amount less than 20 weight %, in particular less than 10 weight %, preferably from 1 to 5 or even 6 weight % of the alloy. The aluminium may form an intermetallic compound with nickel which is known to be mechanically and chemically well resistant.

The anode of the invention may comprise an inner core made of an electronically conductive material, such as metals, alloys, intermetallics, cermets and conductive ceramics, which core is covered with the nickel-iron alloy substrate as a layer. In particular, the core may comprise at least one metal selected from copper, chromium, nickel, cobalt, iron, aluminium, hafnium, molybdenum, niobium, silicon, tantalum, tungsten, vanadium, yttrium and zirconium, and combinations and compounds thereof. For instance, the core may consist of an alloy comprising 10 to 30 weight % of chromium, 55 to 90 weight % of at least one of nickel, cobalt and/or iron and up to 15 weight % of at least one of aluminium, hafnium, molybdenum, niobium, silicon, tantalum, tungsten, vanadium, yttrium and zirconium.

In one embodiment, the core is a non-porous nickel rich nickel-iron alloy, having a nickel/iron weight ratio that is close to or higher than the nickel/iron weight ratio of the nickel-iron alloy substrate, for example from 1 to 4 or higher, in particular above 3. Thus, during use, little or no iron diffuses from the inner core.

Another aspect of the invention relates to a method of manufacturing an anode as described above. The method comprises providing a nickel-iron alloy substrate and oxidising the nickel-iron alloy substrate to produce the electrolyte-pervious electrochemically active nickel-iron oxide containing surface layer which adheres to the nickel metal rich outer portion. The oxidation of the nickel-iron alloy substrate comprises one or more steps at a temperature of 800° to 1200° C., in particular 1050° to 1150° C., for up to 60 hours in an oxidising atmosphere.

Preferably, the nickel-iron alloy substrate is oxidised in an oxidising atmosphere for a short period of time, such as 0.5 to 5 hours.

The oxidising atmosphere may consist of oxygen or a mixture of oxygen and one or more inert gases, such as argon, having an oxygen content of at least 10 molar % of the mixture. Conveniently, the oxidising atmosphere can be air.

In order to obtain a microstructure of the nickel-iron alloy substrate giving upon oxidation an optimal electrochemically active surface layer on an optimal nickel metal rich outer portion, the nickel-iron alloy substrate may be subjected to a thermal-mechanical treatment for modifying its microstructure before oxidation. Alternatively, it may be cast, before oxidation, with known casting additives.

Furthermore, the oxidation of the nickel-iron alloy substrate in an oxidising atmosphere may be followed by a heat treatment in an inert atmosphere at a temperature of 800° to 1200° C. for up to 60 hours. When oxidation in an oxidising atmosphere is partial, it may be completed by oxidation in-situ at the beginning of electrolysis.

As mentioned above, the nickel-iron alloy substrate may be formed as a layer on an inner core made of an electronically conductive material, such as a nickel-rich nickel-iron alloy core. Nickel and iron metal may be deposited as such onto the core, or compounds of nickel and iron may be deposited on the core and then reduced, for example one or more layers of $Fe(OH)_2$ and $Ni(OH)_2$ are deposited onto the core, e.g. as a colloidal slurry, and reduced in a hydrogen atmosphere. Nickel and iron and/or compounds thereof may be co-deposited onto the inner core or deposited separately in different layers which are then interdiffused, e.g. by heat treatment. This heat treatment may take place in an inert atmosphere, such as argon, if the nickel and iron are applied as metals, or a reducing atmosphere, such as hydrogen, if nickel and iron compounds are applied onto the core. The nickel and iron metals and/or compounds may be deposited by electrolytic or chemical deposition, arc or plasma spraying, painting, dipping or spraying.

A further aspect of the invention concerns a cell for the electrowinning of aluminium from alumina dissolved in a fluoride-containing molten electrolyte. The cell according to the invention comprises at least one anode as described above which faces and is spaced from at least one cathode.

The invention also relates to a method of producing aluminium in such a cell. The method comprises passing an ionic current in the molten electrolyte between the cathode(s) and the electrochemically active surface layer of the anode(s), thereby evolving at the anode(s) oxygen gas derived from the dissolved alumina and producing aluminium on the cathode(s).

At the beginning of electrolysis, the nickel metal rich outer portion of the anode(s) may be further oxidised in-situ by atomic and/or molecular oxygen formed on its electrochemically active surface layer, in particular if the anode comprises a surface which is partly oxide-free when immersed into the molten electrolyte, until the oxidised nickel metal rich outer portion of the anode forms an impervious barrier to oxygen.

Advantageously, the method includes substantially saturating the molten electrolyte with alumina and species of at least one major metal, usually iron and/or nickel, present in the electrochemically active surface layer of the anode(s) to inhibit dissolution of the anode(s). The molten electrolyte may be operated at a temperature sufficiently low to limit the solubility of the major metal species thereby limiting the contamination of the product aluminium to an acceptable level.

A "major metal" refers to a metal which is present in the surface of the metal-based anode, in an amount of at least 25 atomic % of the total amount of metal present in the surface of the metal based anode.

The cell can be operated with the molten electrolyte at a temperature from 730° to 910° C., in particular below 870° C.

As disclosed in PCT/IB99/01976 (Duruz/de Nora), the electrolyte may contain $AlF_3$ in such a high concentration that fluorine-containing ions predominantly rather than oxygen ions are oxidised on the electrochemically active surface, however, only oxygen is evolved, the evolved oxygen being derived from the dissolved alumina present near the electrochemically active anode surface.

Preferably, aluminium is produced on an aluminium-wettable cathode, in particular on a drained cathode, for instance as disclosed in U.S. Pat. No. 5,683,559 (de Nora) or in PCT application WO99/02764 (de Nora/Duruz).

In a modification, the nickel of the nickel-iron alloy, in particular of the integral oxide containing surface layer, is wholly or predominantly substituted by cobalt.

DETAILED DESCRIPTION

The invention will be further described in the following Examples:

EXAMPLE 1

An anode was made by pre-oxidising in air at 1100° C. for 1 hour a substrate of a nickel-iron alloy consisting of 60 weight % nickel and 40 weight % iron, to form a very thin oxide surface layer on the alloy.

The surface-oxidised anode was cut perpendicularly to the anode operative surface and the resulting section of the anode was subjected to microscopic examination.

The anode before use had an outer portion that comprised an electrolyte-pervious, electrochemically active iron-rich nickel-iron oxide surface layer having a thickness of up to 10–20 micron and, underneath, an iron-depleted nickel-iron alloy having a thickness of about 10–15 micron containing generally round cavities filled with iron-rich nickel-iron oxide inclusions and having a diameter of about 2 to 5 micron. The nickel-iron alloy of the outer portion contained about 75 weight % nickel.

Underneath the outer portion, the nickel-iron alloy had remained substantially unchanged.

EXAMPLE 2

An anode prepared as in Example 1 was tested in an aluminium electrowinning cell containing a molten electrolyte at 870° C. consisting essentially of NaF and $AlF_3$ in a weight ratio $NaF/AlF_3$ of about 0.7 to 0.8, i.e. an excess of $AlF_3$ in addition to cryolite of about 26 to 30 weight % of the electrolyte, and approximately 3 weight % alumina. The alumina concentration was maintained at a substantially constant level throughout the test by adding alumina at a rate adjusted to compensate the cathodic aluminium reduction. The test was run at a current density of about 0.6 $A/cm^2$, and the electrical potential of the anode remained substantially constant at 4.2 volts throughout the test.

During electrolysis aluminium was cathodically produced while oxygen was anodically evolved which was derived from the dissolved alumina present near the anodes.

After 72 hours, electrolysis was interrupted and the anode was extracted from the cell. The external dimensions of the anode had remained unchanged during the test and the anode showed no signs of damage.

The anode was cut perpendicularly to the anode operative surface and the resulting section of the used anode was subjected to microscopic examination, as in Example 1.

It was observed that the anode had an electrochemically active surface covered with a discontinuous, non-adherent, macroporous iron oxide external layer of the order of 100 to 500 micron thick, hereinafter called the "excess iron oxide layer". The excess iron oxide layer was pervious to and contained molten electrolyte, indicating that it had been formed during electrolysis.

The excess iron oxide layer resulted from the excess of iron contained in the portion of the nickel-iron alloy underlying the electrochemically active surface and which diffuses therethrough. In other words, the excess iron oxide layer resulted from an iron migration from inside to outside the anode during the beginning of electrolysis.

Such an excess iron oxide layer has no or little electrochemical activity. It slowly diffuses and dissolves into the electrolyte until the portion of the anode underlying the electrochemically active surface reaches an iron content of about 15–20 weight % corresponding to an equilibrium under the operating conditions at which iron ceases to diffuse, and thereafter the iron oxide layer continues to dissolve into the electrolyte.

The anode's aforementioned outer portion had been transformed during electrolysis. Its thickness had grown from 10–20 micron to about 300 to 500 micron and the cavities had also grown in size to vermicular form but were only partly filled with iron and nickel compounds. No electrolyte was detected in the cavities and no sign of corrosion appeared throughout the anode.

The absence of any corrosion demonstrated that the pores and/or cracks in the electrolyte-pervious electrochemically active oxide layer were sufficiently small that, when polarised during use, the voltage drop through the pores and/or cracks was below the potential of electrolytic dissolution of the oxide of the surface layer.

Underneath the outer portion, the nickel-iron alloy had remained unchanged.

The shape and external dimensions of the anode had remained unchanged after electrolysis which demonstrated stability of this anode structure under the operating conditions in the molten electrolyte.

In another test a similar anode was operated under the same conditions for several hundred hours at a substantially constant current and cell voltage which demonstrated the long anode life compared to known non-carbon anodes.

EXAMPLE 3

An anode having a generally circular active structure of 210 mm outer diameter was made of three concentric rings spaced from one another by gaps of 6 mm. The rings had a generally triangular cross-section with a base of about 19 mm and were connected to one another and to a central vertical current supply rod by six members extending radially from the vertical rod and equally spaced apart from one another around the vertical rod. The gaps were covered with chimneys for guiding the escape of anodically evolved gas to promote the circulation of electrolyte and enhance the dissolution of alumina in the electrolyte as disclosed in PCT publication WO00/40781 (de Nora).

The anode and the chimneys were made from cast nickel-iron alloy containing 50 weight % nickel and 50 weight % iron that was heat treated as in Example 1. The anode was then tested in a laboratory scale cell containing an electrolyte as described in Example 2 except that it contained approximately 4 weight % alumina.

During the test, a current of approximately 280 A was passed through the anode at an apparent current density of about 0.8 $A/cm^2$ on the apparent surface of the anode. The electrical potential of the anode remained substantially constant at approximately 4.2 volts throughout the test.

The electrolyte was periodically replenished with alumina to maintain the alumina content in the electrolyte close to saturation. Every 100 seconds an amount of about 5 g of fine alumina powder was fed to the electrolyte. The alumina feed was periodically adjusted to the alumina consumption based on the cathode efficiency, which was about 67%.

As in Examples 2, during electrolysis aluminium was cathodically produced while oxygen was anodically evolved which was derived from the dissolved alumina present near the anodes.

After more than 1000 hours, i.e. 42 days, electrolysis was interrupted and the anode was extracted from the cell and allowed to cool. The external dimensions of the anode had not been substantially modified during the test but the anode was covered with iron-rich oxide and bath. The anode showed no sign of damage.

The anode was cut perpendicularly to the anode operative surface and the resulting section of a ring of the active structure was subjected to microscopic examination, as in Example 1.

It was observed that the porous outer alloy portion had grown inside the anode ring to a depth of about 7 mm leaving only an inner portion of about 5 mm diameter unchanged, i.e. consisting of a non-porous alloy of 50 weight % nickel and 50 weight % iron. The porous outer portion of the anode had a concentration of nickel varying from 85 to 90 weight % at the anode surface to 70 to 75 weight % nickel close to the non-porous inner portion, the balance being iron. The iron depletion in the openly porous outer portion corresponded about to the accumulation of iron present as oxide on the surface of the anode, which indicated that the iron oxide had not substantially dissolved into the electrolyte during the test.

As in the previous Example, the anode showed no sign of corrosion which demonstrated that the pores and/or cracks in the electrolyte-pervious electrochemically active oxide layer were sufficiently small that, when polarised during use, the voltage drop through the pores and/or cracks was below the potential of electrolytic dissolution of the oxide of the surface layer.

What is claimed is:

1. An anode of a cell for the electrowinning of aluminium from alumina dissolved in a fluoride-containing molten electrolyte, said anode comprising a nickel-iron alloy substrate having a nickel metal rich outer portion with an integral nickel-iron oxide containing surface layer which adheres to the nickel metal rich outer portion of the nickel-iron alloy substrate and which is pervious to electrolyte by the presence of pores and/or cracks therein, the surface layer in use being electrochemically active for the evolution of oxygen gas and containing electrolyte in said pores and/or cracks which are so small that when the surface layer is polarised the potential differential through the electrolyte-containing pores and/or cracks is below the potential for electrolytic dissolution of the oxide of the surface layer.

2. The anode of claim 1, wherein the electrochemically active surface layer has a thickness of less than 50 micron.

3. The anode of claim 1, wherein the electrochemically active surface layer has a thickness of less than 100 micron.

4. The anode of claim 1, wherein the electrochemically active surface layer has a thickness of less than 200 micron.

5. The anode of claim 1, which has a Ni/Fe atomic ratio below 1 before use.

6. The anode of claim 1, which has a Ni/Fe atomic ratio above 1, in particular from 1 to 4, before use.

7. The anode of claim 1, wherein the nickel metal rich outer portion has a porosity containing cavities which are partly or completely filled with iron and nickel compounds, said porosity being obtainable by oxidation in an oxidizing atmosphere before use.

8. The anode of claim 1, wherein the nickel metal rich outer portion has a decreasing concentration of iron metal towards the electrochemically active surface layer.

9. The anode of claim 8, wherein the nickel metal rich outer portion comprises nickel metal and iron metal in an Ni/Fe atomic ratio of more than 3 where it reaches the electrochemically active surface layer.

10. The anode of claim 1, wherein the nickel-iron alloy comprises a non-porous inner portion which is oxide-free.

11. The anode of claim 1, wherein the electrochemically active surface layer comprises iron-rich nickel-iron oxide.

12. The anode of claim 11, wherein the electrochemically active surface layer comprises nickel-ferrite.

13. The anode of claim 12, wherein the nickel-ferrite of the electrochemically active surface layer contains non-stoichiometric nickel-ferrite having an excess of iron or nickel, and/or an oxygen deficiency.

14. The anode of claim 1, wherein the nickel-iron alloy comprises nickel metal and iron metal in a total amount of at least 65 weight %, in particular at least 80 weight %, preferably at least 90 weight % of the alloy.

15. The anode of claim 14, wherein the nickel-iron alloy comprises at least one further metal selected from chromium, copper, cobalt, silicon, titanium, tantalum, tungsten, vanadium, zirconium, yttrium, molybdenum, manganese and niobium in a total amount of up to 10 weight % of the alloy.

16. The anode of claim 14, wherein the nickel-iron alloy comprises at least one catalyst selected from iridium, palladium, platinum, rhodium, ruthenium, tin or zinc metals, Mischmetals and their oxides and metals of the Lanthanide series and their oxides as well as mixtures and compounds thereof, in a total amount of up to 5 weight % of the alloy.

17. The anode of claim 14, wherein the nickel-iron alloy comprises aluminium in an amount less than 20 weight %, in particular less than 10 weight %, preferably from 1 to 6 weight % of the alloy.

18. The anode of claim 1, comprising a core made of an electronically conductive material which is covered with the nickel-iron alloy substrate.

19. The anode of claim 18, wherein the core is made of metals, alloys, intermetallics, cermets and conductive ceramics.

20. The anode of claim 19, wherein the core is a nonporous nickel rich nickel-iron alloy.

21. A method of manufacturing an anode according to claim 1 for use in a cell for the electrowinning of aluminium, comprising providing a nickel-iron alloy substrate and oxidising the nickel-iron alloy substrate to produce said electrolyte-pervious electrochemically active nickel-iron oxide containing surface layer which adheres to the nickel metal rich outer portion, the oxidation of the nickel-iron alloy substrate comprising one or more steps at a temperature of 800° to 1200° C. for up to 60 hours in an oxidising atmosphere.

22. The method of claim 21, comprising oxidising the nickel-iron alloy substrate in an oxidising atmosphere for 0.5 to 5 hours.

23. The method of claim 21, wherein the oxidising atmosphere consists of oxygen or a mixture of oxygen and one or more inert gases having an oxygen content of at least 10 molar % of the mixture.

24. The method of claim 21, wherein the oxidising atmosphere is air.

25. The method of claim 21, wherein the nickel-iron alloy is oxidised at a temperature of 1050° to 1150° C.

26. The method of claim 21, comprising subjecting the nickel-iron alloy substrate to a thermal-mechanical treatment to modify its microstructure before oxidation.

27. The method of claim 21, comprising casting the nickel-iron alloy substrate with additives to provide a microstructure for enhancing oxidation.

28. The method of claim 21, wherein oxidation in the oxidising atmosphere is followed by a heat treatment in an inert atmosphere at a temperature of 800° to 1200° C. for up to 60 hours.

29. The method of claim 21, wherein the oxidation in the oxidising atmosphere is partial and completed in-situ by oxidation at electrolysis start-up.

30. The method of claim 21, comprising forming the nickel-iron alloy substrate on a core.

31. The method of claim 30, comprising depositing nickel and iron metal on the core.

32. The method of claim 30, comprising depositing nickel and iron compounds on the core and then reducing the compounds.

33. The method of claim 32, wherein the nickel and iron compounds are $Fe(OH)_2$ and $Ni(OH)_2$ which are reduced in a hydrogen atmosphere.

34. The method of claim 30, comprising co-depositing nickel and iron and/or compounds thereof onto the core.

35. The method of claim 30, comprising depositing at least one layer of iron and/or an iron compound and at least one layer of nickel and/or a nickel compound onto the core, and then interdiffusing the layers.

36. The method of claim 30, comprising depositing electrolytically or chemically at least one of nickel, iron and compounds thereof onto the core.

37. The method of claim 30, comprising arc spraying or plasma spraying at least one of nickel, iron and compounds thereof onto the core.

38. The method of claim 30, comprising applying at least one of nickel, iron and compounds thereof by painting, dipping or spraying onto the core.

39. A cell for the electrowinning of aluminium from alumina dissolved in a fluoride-containing molten electrolyte, the cell comprising at least one anode as defined in claim 1 facing and spaced from at least one cathode.

40. A method of producing aluminium in a cell according to claim 39 containing alumina dissolved in a molten electrolyte, the method comprising passing an ionic current in the molten electrolyte between the cathode(s) and the electrochemically active surface layer of the anode(s), thereby evolving at the anode(s) oxygen gas derived from the dissolved alumina and produce aluminium on the cathode(s).

41. The method of claim 40, comprising further oxidising said nickel metal-rich outer portion of at least one anode in-situ by atomic and/or molecular oxygen formed on its electrochemically active surface layer, in particular when the anode comprises a surface which is partly oxide-free when immersed into the molten electrolyte, until the oxidised nickel metal rich outer portion of the anode forms a barrier impervious to oxygen.

42. The method of claim 40, comprising permanently and uniformly substantially saturating the molten electrolyte with alumina and species of at least one major metal present in the electrochemically active surface layer of the anode(s) to inhibit dissolution of the anode(s).

43. The method of claim 40, wherein the cell is operated with the molten electrolyte at a temperature sufficiently low to limit the solubility of said major metal species thereby limiting the contamination of the product aluminium to an acceptable level.

44. The method of claim 40, wherein the cell is operated with the molten electrolyte at a temperature from 730° to 910° C.

45. The method of claim 44, wherein aluminium is produced on an aluminium-wettable cathode, in particular a drained cathode.

* * * * *